US008714086B2

(12) United States Patent
Belfiore et al.

(10) Patent No.: US 8,714,086 B2
(45) Date of Patent: May 6, 2014

(54) METHOD FOR MAKING A CYLINDRICALLY-SHAPED ELEMENT FOR USE IN PRINTING

(75) Inventors: David Anthony Belfiore, Landenberg, PA (US); William Paul Rhodes, Newark, DE (US); John E. Gantzhorn, Jr., Hockessin, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 272 days.

(21) Appl. No.: 13/303,596

(22) Filed: Nov. 23, 2011

(65) Prior Publication Data

US 2012/0298000 A1 Nov. 29, 2012

Related U.S. Application Data

(60) Provisional application No. 61/419,308, filed on Dec. 3, 2010.

(51) Int. Cl.
*B41C 1/18* (2006.01)
*B41N 6/00* (2006.01)

(52) U.S. Cl.
CPC .. *B41C 1/182* (2013.01); *B41N 6/00* (2013.01)
USPC ..... 101/401.1; 101/395

(58) Field of Classification Search
CPC ..... B41C 1/18; B41C 1/182; B41C 2201/06; B41C 201/04; B41N 1/00; B41N 1/16; B41N 10/00; B41N 10/02; B41N 10/04; B41N 2207/04; B41N 2207/06; B41N 2210/04; B41N 2210/06
USPC ..... 101/368, 395, 216, 217, 376, 401.1; 428/909
See application file for complete search history.

(56) References Cited

U.S. PATENT DOCUMENTS

| | | | |
|---|---|---|---|
| 3,978,254 | A | 8/1976 | Hoexter et al. |
| 3,981,237 | A | 9/1976 | Rhodes |
| 4,171,626 | A | 10/1979 | Yates et al. |
| 4,214,932 | A | 7/1980 | Van Auken |
| 4,554,040 | A | 11/1985 | van der Velden |
| 4,869,997 | A | 9/1989 | Koch et al. |
| 4,903,597 | A | 2/1990 | Hoage et al. |
| 5,076,871 | A | 12/1991 | Frye et al. |
| 5,131,325 | A | 7/1992 | Blauvelt |
| 5,301,610 | A | 4/1994 | McConnell |
| 5,334,124 | A | 8/1994 | Ohno |

(Continued)

FOREIGN PATENT DOCUMENTS

| | | | |
|---|---|---|---|
| EP | 766142 | A1 | 2/1997 |
| GB | 1530504 | | 11/1978 |

*Primary Examiner* — Ren Yan
*Assistant Examiner* — Ruben Parco, Jr.

(57) ABSTRACT

This invention pertains to a method for making a cylindrically-shaped element, and particularly a cylindrically-shaped element for use as a base sleeve for printing or as a support for a print form. The method includes wrapping a sheet of a material having a first end and a second end to bring the second end adjacent the first end to form a base sleeve having an axial seam of the first and second ends. The first end has a non-linear edge having an amplitude. Portions between the first end and the second end overlap and form the axial seam. The method can include applying an imageable material adjacent an exterior surface of the base sleeve that covers at least a portion of the axial seam.

47 Claims, 2 Drawing Sheets

(56) References Cited

U.S. PATENT DOCUMENTS

| | | | | |
|---|---|---|---|---|
| 5,352,507 | A | 10/1994 | Bresson et al. | |
| 5,383,062 | A | 1/1995 | Sato et al. | |
| 5,468,568 | A | 11/1995 | Kuhn et al. | |
| 5,698,055 | A | 12/1997 | Benkoczy | |
| 5,753,324 | A | 5/1998 | Aoyagi et al. | |
| 5,795,524 | A | 8/1998 | Basso, Jr. et al. | |
| 5,974,972 | A | 11/1999 | Van Denend et al. | |
| 6,036,470 | A | 3/2000 | Basso, Jr. et al. | |
| 6,699,548 | B2 | 3/2004 | van Weperen et al. | |
| 6,703,095 | B2 | 3/2004 | Busshoff et al. | |
| 7,081,331 | B2 | 7/2006 | Vest | |
| 2004/0126682 | A1* | 7/2004 | Dreher et al. | 430/11 |
| 2005/0194087 | A1* | 9/2005 | Rossini et al. | 156/190 |
| 2005/0196570 | A1* | 9/2005 | Lindsay | 428/36.9 |
| 2006/0207453 | A1* | 9/2006 | Grieser et al. | 101/376 |
| 2008/0041249 | A1* | 2/2008 | D'Hauwe | 101/217 |

* cited by examiner

METHOD FOR MAKING A CYLINDRICALLY-SHAPED ELEMENT FOR USE IN PRINTING

BACKGROUND OF THE INVENTION

1. Field of the Disclosure

This invention pertains to a method for making a cylindrically-shaped element, and particularly a cylindrically-shaped element for use as a base sleeve for printing or as a support for a print form.

2. Description of Related Art

In flexographic printing operations, flat, flexible plates can be hand-mounted onto print cylinders by wrapping and adhering the plates to the underlying cylinder. Generally, the flat plate includes a base support having either a rubber layer with relief indicia or a photocurable polymer layer thereon. In some instances, a compressible layer is positioned between the base support and rubber or photocurable layer to improve print quality. Such flat plates have the advantage that they could be relatively thin and flexible because they directly mounted to the print cylinder. However, such mounting processes are labor intensive and slow, and plates can not be easily removed from the print cylinder for reuse in a subsequent print run.

Hollow cylindrical sleeves have served as supports for various print forms. In some cases a print form consists of printing plate/s mounted to the cylindrical sleeve. In other cases a print form consists of a continuous layer of photopolymer or rubber, which can be imaged, applied to an exterior surface of the cylindrical sleeve. A cylindrical sleeve may sometimes be referred to as a base sleeve. There are particular advantages to using print forms having the continuous layer of an imageable photopolymer or rubber on a cylindrical sleeve. Continuous print forms have applications in flexographic printing of continuous designs such as in wallpaper, decoration and gift wrapping paper.

The use of cylindrical sleeves as well as continuous print forms is becoming increasingly more common in the industry. Unlike plates, sleeves are not adhered to the print cylinder and thus allow for the capability to easily reuse print forms for subsequent print runs. Sleeve technology also permits very rapid and simple changing of the print form on a print cylinder. The internal diameter of a cylindrical sleeve corresponds to the external diameter of the print cylinder so that the sleeve can be simply slid over the print cylinder of the printing press. The print cylinder is equipped with compressed air for facilitating the mounting and de-mounting (i.e., pushing on and pushing off) of the sleeve onto and from the print cylinder. Compressed air is connected to the print cylinder which passes into the interior of the cylinder and emerges via holes arranged on the exterior surface of the cylinder to create an air cushion for mounting and de-mounting the sleeve. For mounting a sleeve, compressed air emerges at the surface holes of the print cylinder and the sleeve is pushed on the exterior surface of the print cylinder creating the cushion of air that substantially reduces the friction between the sleeve and the print cylinder. Since the sleeve expands slightly under the influence of the air cushion, the sleeve easily slides along the print cylinder to the desired position. When the compressed air is terminated, the sleeve no longer can stay expanded and contracts to reside firmly on the print cylinder. However, cylindrical sleeves need to withstand the rigors of mounting and de-mounting from the print cylinder with compressed air.

Thin-walled cylindrical sleeves, that is, sleeves having a wall thickness of about 0.050 inch or less (0.127 cm or less), have particular advantages due to low manufacturing costs, increase production, and ease of use due to their low weight and flexibility. Thin-walled cylindrical sleeves can also easily be mated with bridge sleeves to attain the desired repeat of a printed image with existing print cylinders, and with cushion sleeves to attain suitable print quality, for example, reduced dot gain. Various configurations of cylindrical sleeves are known from U.S. Pat. Nos. 4,214,932; 5,383,062; 5,468,568; 5,753,324; 5,974,972; 6,699,548; and 6,703,095. Generally these prior art sleeves consist of a plurality of associated concentric layers, and perhaps one or more underlying support layers. These known cylindrical sleeves however exhibit a number of constraints with respect to their manufacture and use.

Problems sometimes arise with cylindrical sleeves that are produced with seams where ends or edges of material are joined to form the sleeve. Production of sleeves with seams is particularly difficult since the edges of the material forming the seam need to have sufficient contact to assure an air-tight seal for the sleeve, but yet not have a buildup or allowance of excess material at the seam that can impact print performance by the print form. It is particularly time- and labor-intensive to produce sleeves having seams with edges that sufficiently abut with no or only minimal allowance and contrary toward a goal of manufacturing high volumes of cylindrical sleeves in a plurality of sizes (based on diameter as well as axial length of the cylinder). A sleeve may break or separate at a seam under the application of pressurized air when mounting and de-mounting of cylindrical print forms, thereby rendering the print form inoperable. The seams may not fully form and result in a lack of air tightness necessary for proper mounting of the sleeve onto a print cylinder. Buildup or excess seam allowance of material at the seam results in non-uniformities in the sleeve which can transmit through the one or more layers disposed on the exterior surface of the sleeve, such as the relief image layer, and result in a printing defect, which is sometimes referred to as "print through". Print through manifests as repeating distortion/s or disturbance/s in the image printed on the substrate, which correspond to the underlying seam structure in the print sleeve. Print through of a seam to the printed image can exhibit a region of slightly higher or lower density of the image compared to the image printed by the remaining, i.e., non-seam parts, of the sleeve. A seam that is thicker or thinner or has different characteristic response under impression than the remaining non-seam portion of the sleeve generally will print through to the printed image. Also, a poorly-formed seam can interfere with the application of one or more layers, such as a photopolymeric layer, onto the exterior surface of the sleeve. Sometimes, the exterior surface of the sleeve is ground to provide desired uniformity of the wall thickness at the seam and for the remainder of the sleeve. However, grinding the surface introduces an additional step in a process of making the sleeve which, for costs and production purposes, is desirable to avoid.

So a need arises for a cylindrical sleeve that is easily and quickly produced, at a low cost, while avoiding the problems of prior cylindrical sleeves. It is desirable to form the cylindrical sleeve in one or more layers from sheet material, and yet avoid defects associated with seam non-uniformities, such as print through, that can be observed in an image printed by the print form, and facilitate the application of additional layers onto the sleeve. The cylindrical sleeve should be capable of supporting print plate/s or a continuous layer of an imageable photopolymer or rubber and withstanding the rigors of mounting and de-mounting with pressurized air onto a print cylinder. The cylindrical sleeve should be capable of maintaining dimensional stability and tolerances during subsequent manufacturing steps, such as formation of the continuous layer thereon, and/or undergoing imaging and treating steps, such as solvent washout or heating, to form a relief surface of the continuous layer that is suitable for printing.

SUMMARY

In accordance with this invention there is provided a method for making a cylindrically-shaped base sleeve for use as a printing form comprising: a) providing a first sheet of a material having a first end and a second end opposite the first end; b) wrapping the sheet on a cylindrical support member to bring the second end adjacent the first end thereby forming the sheet into the base sleeve having an exterior surface and a seam of the first and second ends; wherein the first end forms a non-linear edge that has an amplitude and overlaps portions of the second end; c) repeating steps a) and b) with one or more additional sheets of material each having at least one end that forms a non-linear edge; and d) curing the base sleeve resulting from step c).

In accordance with another aspect of this invention there is provided a method for making a cylindrically-shaped element for use as a printing form comprising: a) providing a first sheet of a material having a first end and a second end opposite the first end; b) wrapping the sheet to bring the second end adjacent the first end thereby forming the sheet into a base sleeve having an exterior surface and a seam of the first and second ends; and c) applying an imageable material adjacent the exterior surface that covers at least a portion of the seam; wherein the first end forms a non-linear edge that has an amplitude and overlaps portions of the second end.

BRIEF DESCRIPTION OF THE DRAWINGS

The invention can be more fully understood from the following detailed description thereof in connection with the accompanying drawings described as follows.

DESCRIPTION OF THE PREFERRED EMBODIMENTS

Figure 1:
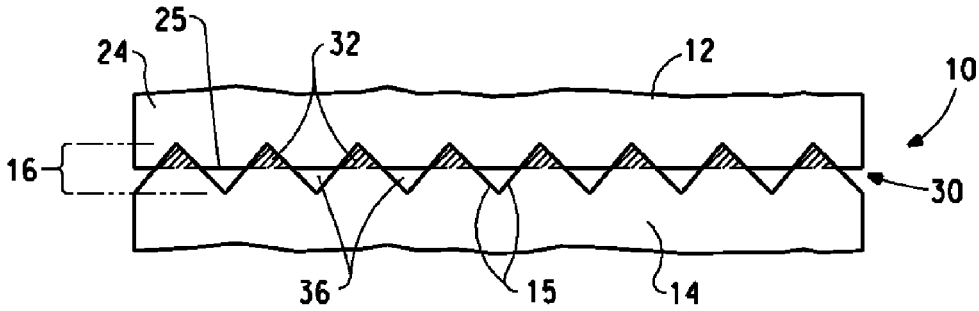
FIG. 1 is a schematic planar top view of one embodiment of a seam created to form a base sleeve for a cylindrically-shaped element from a sheet having a first end with a non-linear edge and a second end, wherein portions of the first end and the second end overlap.

Throughout the following detailed description, similar reference characters refer to similar elements in all figures of the drawings.

The present invention relates to a method for making a cylindrically-shaped element for use in a printing form, or as a printing form. The cylindrically-shaped element is tubular, i.e., a hollow elongated cylinder, having an interior surface and an exterior surface. The cylindrically-shaped element has an axial length taken along a longitudinal axis running through the hollow of the element. The axial length of the cylindrically-shaped element may also be referred to herein as a width of the element. The printing form may be suited for relief printing, including use as a flexographic printing form and letterpress printing form. Relief printing is a method of printing in which the printing form prints from an image area, where the image area of the printing form is raised and the non-image area is depressed. Alternatively the printing form may be suited for gravure or gravure-like printing. Gravure printing is a method of printing in which the printing form prints from an image area, where the image area is depressed and consists of small recessed cups or wells to contain the ink or printing material, and the non-image area is the surface of the form. Gravure-like printing is similar to gravure printing except that a relief printing form is used wherein the image area is depressed and consists of recesses areas forming wells to carry the ink which transfer during printing. In some embodiments, the cylindrically-shaped element may be used to support one or more plates, so called plate-on-sleeve. In most instances, a relief surface suitable for printing is formed in the plate/s prior to securing the plate/s on the cylindrically-shaped element. In other embodiments, the cylindrically-shaped element may be used as a support for a continuous or substantially continuous layer of photopolymer or rubber that can be imaged to form a relief suitable for printing. It is contemplated that the cylindrically-shaped element may also be suitable for other end uses primarily in printing. The cylindrically-shaped element may be referred to herein as a sleeve, or base sleeve, or composite sleeve, or sleeve blank.

The method includes providing a sheet of a material having a first end and a second end opposite the first end. The sheet encompasses material that is relatively thin in comparison to its length and width, and includes extended strip/s of material, such as a substantially continuous web of material. The material is not limited provided that it is sufficiently pliable and can be manipulated to form the cylindrically-shaped element according to the present invention, and once formed into a sleeve can suitably perform in printing end use. The material can be selected from fibrous materials, such as, woven fabrics, non-woven fabrics; and non-fibrous materials, such as polymeric films. Examples of suitable fibrous materials include glass fibers; stretched fibers, such as aramid fibers and polyethylene fibers; carbon fibers; metal fibers; ceramic fibers, and combinations thereof. Fibrous materials are offered in a variety of thread types and sizes, thread densities (e.g., threads per inch in each direction), fabric thread weaves and fabric thicknesses. Examples of a polymeric film include films formed by addition polymers and linear condensation polymers, such as linear polyesters; films of polyvinyl resins, such as polyvinyl chloride, and polyvinyl acetate; and films of polystyrene. One embodiment of a polymeric film is polyethylene terephthalate. The material, particularly a fibrous material, is generally set into the cylindrically-shaped form with the use of a resin, which in most embodiments is a curable resin. The resin may be a thermoplastic resin or a thermosetting resin. Examples of suitable resins include polyester resins; phenolic resins; vinyl-ester resins, epoxy resins, and polyepoxide phenolic resins. In most embodiments the resin is a thermally-curable resin, such as an epoxy resin. In other embodiments, the resin is curable by exposure to actinic radiation, such as ultraviolet radiation. In yet other embodiments, the resin may be both thermally- and radiation-curable resin. It is well within the ordinary skill of one in the art of print sleeves to select sheet material and resin material that will provide the base sleeve with desired characteristics.

In general in most embodiments, the sheet material and resin material are selected based upon a minimum number of layers of sheet material that can be used to provide the desired cured wall thickness of the base sleeve and yet provide the base sleeve with desired mechanical properties, such as tensile strength and modulus of elasticity, for end-use. The fewer the layers of material sheets needed to reach desired wall thickness reduces the cost of manufacturing the base sleeve. The sheet material and resin material should also be selected such that the resulting base sleeve is capable of undergoing subsequent steps to convert a precursor to a print form without negatively impacting desired end-use characteristics of the base sleeve as well as the print form. For example, the base sleeve should be resistant to treatment by washout solvent or by heat that are applied to the imageable material of the print form.

In some embodiments, the sheet material and resin material are selected such that after cure the base sleeve has some degree of transparency to actinic radiation. In some embodiments, at least 15% of actinic radiation is transmitted through the base sleeve. In other embodiments, at least 30% of actinic radiation is transmitted through the base sleeve. Transparency of the base sleeve to actinic radiation allows for the capability to form a floor of the imageable material adjacent the exterior surface of the base sleeve by exposing from the hollow area of the base sleeve to create a suitable print form. In other embodiments the cured base sleeve is opaque or substantially opaque to actinic radiation, and other methods to create the floor of the imageable material for the print form are possible. If cured by heat, the resin material can be selected to have a relatively low cure temperature.

In most embodiments, the base sleeve is formed from at least one sheet of a composite material composed of a fibrous material and a curable resin. In some embodiments, the base sleeve is formed from at least one sheet of composite material composed of a fabric of glass fibers that is pre-impregnated with a curable resin. In one embodiment, the composite material can have a resin content of about 25 to about 60% by weight. In other embodiments, the base sleeve is formed from at least one sheet of a material composed of glass fibers that is shaped and then applied with a coating of a curable resin. The composite material may contain other conventional additives such as lubricants, adhesion-promoting agents, fillers, pigments, and the like. Composite materials composed of fibrous material pre-impregnated with resin are commercially available from a variety of suppliers. Some composite materials that are pre-impregnated with an epoxy resin are stored or held at cold temperatures, i.e., temperature at or below 0° C., and then thawed or brought to room temperature prior to use.

The sheet of material has a first end and a second end opposite the first end. In one embodiment, at least one of the ends of the sheet forms a non-linear edge having an amplitude. Amplitude of the non-linear edge is a deviation from a theoretical straight edge, measured perpendicular to the edge. In some embodiments the amplitude may be a maximum deviation from the theoretical straight edge, but is not so limited. In another embodiment, both ends of the sheet forms a non-linear edge having an amplitude, which may be the same or different. A non-linear edge is a continuous edge having at least two adjoining segments that are non-parallel to one another, that is, having a shape or outline having at least one non-straight profile. In most embodiments, the non-linear edge will have a plurality of waves or a waveform. In this embodiment, the non-linear edge can be considered a waveform as the non-linear edge can represent waves having a displacement (i.e., amplitude or height) of each wave relative to its distance along the axial length, i.e., width, from a fixed location on the sleeve. Each wave of the waveform can be the same or different from another, for example, different in shape, in amplitude, and/or in period. The shape of each wave of the waveform is not limited, and can include: one or more segments forming the wave that independently can be straight or curved; and have a transition between segments that can be sharply-transitioned (i.e., pointed) peak and/or valley, as well as softly-transitioned (i.e., rounded) peak and/or valley. In most embodiments, the amplitude of the non-linear edge is a height of at least one wave, measured parallel or substantially parallel to a plane of the sheet, from a line that is perpendicular to a side (edge) of the sheet that is adjacent to the non-linear edge, to the non-linear edge of the wave. In some embodiments, the non-linear edge forms a waveform of a plurality of curve-shaped waves. In other embodiments, the non-linear edge forms a waveform of a plurality of "v-shaped" or substantially "v-shaped" waves, which may be referred to as a zigzag edge or pattern. In embodiments where the non-linear edge forms a waveform with a plurality of waves that are different, the amplitude of the non-linear edge is typically a maximum height of one or more of the plurality of waves, measured parallel or substantially parallel to a plane of the sheet, from a line that is perpendicular to a side of the sheet that is adjacent to the non-linear edge, to the non-linear edge of the waves. More simply, in some embodiments the amplitude is a distance measured from a peak of the wave at the non-linear edge to a line connecting adjacent lowermost portions, i.e., valleys or pits of the wave, encompassing the peak. In other embodiments, the amplitude is a distance measured from a peak of the wave at the non-linear edge to a line located about midway between adjacent lowermost portions, i.e., valleys of the wave, and the peak. In some embodiments, the amplitude is measured perpendicular or substantially perpendicular from the peak to the connecting line. Generally, the measured amplitude of the wave is above the connecting line between the adjacent valleys.

The height of the amplitude, or amplitude, of the non-linear edge is relative to the printing conditions in the end-use of the sleeve. In most embodiments, the height of the amplitude chosen for the non-linear edge is relative to a print nip width, which is a width of the printing zone created at a nip between the print form (having the present base sleeve) that is mounted on a printing cylinder and an impression roll on a print press. The height of the amplitude of the non-linear edge is the same or substantially the same or larger than the print nip width. If the height of the amplitude is less than the print nip width the seam region may have a tendency to print through to the printed image. In some embodiments, it is desirable for ease in manufacture that the amplitude is as small as possible, that is the amplitude height is about the same as print nip width. In embodiments for applications in which the sleeve is used for flexographic printing, the amplitude of the non-linear edge can be from about 0.15 to about 0.55 inch (0.38 to 1.4 cm). In some embodiments, the amplitude is from about 0.15 to 0.25 inch (0.38 to 0.64 cm). In most embodiments the amplitude for each of the waves of a waveform forming the non-linear edge is the same or substantially the same. However, other embodiments are contemplated in which the amplitude for two or more of the waves of a waveform forming the non-linear edge can be different or vary. In embodiments in which the first end has a non-linear edge and the second end has a non-linear end, the amplitude of the first end can be the same or different from the amplitude of the second end. In other embodiments for applications in which the sleeve is used for other printing methods, such as gravure printing, the amplitude of the non-linear edge may still be relative to the print nip width but other factors may influence the chosen amplitude. It is possible that a suitable range for the amplitude for a non-linear edge in a base sleeve for use gravure printing may be the same as, or substantially the same as, or significantly different from the range recited for a base sleeve for flexographic use. The amplitude suitable for the non-linear edge of the print sleeve may also change for different diameters (or ranges of diameters) of the print sleeve being formed.

The non-linear edge includes at least one wave having a period which is a distance between adjacent lowest points of the wave, which also may be referred to as a width of a wave, or period width, or wave width. In most embodiments, the non-linear edge includes a plurality of waves of the waveform, each of which can have the same or different period width. The period width of each of the waves along the non-linear edge is not particularly limited, and can be about 2.5 to about 15 inch (6.4 to 38.1 cm). This would correspond to a frequency of the wave of about 0.4 to about 0.067 cycles per inch (0.16 to 0.027 cycles per cm). In some embodiments, the period of the waves along the non-linear edge is from about 3 to about 8 inch (7.6 to 20.3 cm) and in other embodiments from about 8.5 to about 12 inch (21.6 to 30.5 cm). In most embodiments the period for each of the waves of the waveform forming the non-linear edge is the same or substantially the same. However, other embodiments are contemplated in which the period for two or more of the curves of a waveform forming the non-linear edge can be different or vary. The seam has a repeat distance of a pattern forming the seam, measured in a direction substantially parallel to the non-linear edge. The repeat distance of the seam pattern may be referred to as seam pattern period. There may be one or more different seam pattern periods along the seam. In some embodiments, the seam pattern period is the same or substantially the same as the wave period. In other embodiments, particularly when the waveform is composed of waves of different shapes and/or periods, the seam pattern period is different from the wave period. The period of the waves forming the non-linear edge may or may not change according to the axial length of the base sleeve being formed.

The sheet of material can be cut to an appropriate size and shape, including the non-linear edge, to form the base sleeve with a cutting table. An x-y cutting table for mechanical working of materials in sheet format can be suitable for cutting the sheet of material to the desired size and shape, and in particular for providing at least one end of the material sheet with a non-linear edge having a desired amplitude of a waveform. In most embodiments, the edge of the material sheet has a blunt cut, forming about a 90 degree edge with the plane of the sheet. Alternatively, the edge of the material sheet can be cut at an angle relative to the plane of the sheet. Commercially available cutting tables and systems suitable for use in the present invention are sold by EskoArtwork (Belgium) as Kongsberg cutting tables, as well as by Eastman Machine Company (Buffalo, N.Y.) and Gerber Scientific (South Windsor, Conn.).

The method includes wrapping the sheet to bring the second end adjacent the first end thereby forming the sheet into a cylindrical shape, i.e., a base sleeve, having an exterior surface and a seam of the first end and the second end. The seam formed by the adjacency of the first and second ends creates a discontinuous seam region that includes at least one portion of the material of the first end and second end that overlap, and at least one portion of the first and second ends that form a gap. In most embodiments, the seam or seam region of the base sleeve is an area that includes the overlap portions and gap portions that encompasses the valleys and peaks of the amplitude of the waveform of the first end, and if the second end has a non-linear edge, the valleys and peaks of the amplitude of the waveform of the second end, along the length of the base sleeve. A gap or gap portion of the seam is an area in which the material of the first end and the second end do not overlap or touch each other. Upon wrapping, a seam forms in which there is no contact of the sheet material at one or more of the gaps between the first end and the second end, and there is contact of the sheet material at the one or more overlap portions between the amplitude of the first end and the second end. One or more of the gap or gap portions do not have sheet material, but may or may not include resin material. If upon wrapping of the sheet material one or more of the gaps do not include resin material, in some embodiments curing may cause the resin material to flow or otherwise transition sufficiently, in whole or in-part, into one or more of the gap/s at the seam. Whether or not the gap portion fills with resin material, the seam formed is still considered a discontinuous seam of overlapped portion/s and gap portion/s, as the gap portions do not include fibrous material. In most embodiments, about 15% to about 90% of the first end having the non-linear edge overlaps the second end. In some embodiments, about 20% to about 80% of the first end having the non-linear edge overlaps the second end. In some other embodiments, about 25% to about 65% of the first end having the non-linear edge overlaps the second end. In yet other embodiments, about 20% to 50% of the first end having the non-linear edge overlaps the second end. In most embodiments the percentage of first end overlapping the second end is based upon total area forming the non-linear edge. In other embodiments the percentage is based upon the area of the amplitude for each wave of the non-linear edge.

The seam formed in the present base sleeve distributes the discontinuity between the first end and the second end so that the entire seam is not in a print zone at the same time. In most embodiments, the seam or seam region of the base sleeve is the same or substantially the same or larger than the print nip width. In most embodiments, the discontinuous seam region includes a plurality of overlapping portions and a plurality of gaps. The overlap portion/s of the first end and the second end are more than edge-to-edge contact of the first and second ends. The overlap portion of the first end and the second end denotes that the first end and the second end form a portion with two layers of the sheet material, one layer from the first end portion and one layer from a portion of the second end. The term overlapping portions is not limited to a particular layer position of the first end relative to the second end, and encompasses portions of the first end that lap over the second end as well as portions of the first end that lap under the second end. As such, the overlapping portion includes embodiments in which at least one portion of the first end having the non-linear edge is on top of the second end; embodiments in which at least one portion of the first end having the non-linear edge is below the second end; and, embodiments of the combination in which one or more portions of the first end having the non-linear edge is on top of the second end and one or more portions of the first end having the non-linear edge is below the second end. In some embodiments, the overlapping portions of the first end and the second end are in direct contact. In other embodiments, the overlapping portions of the first end and the second end are not in direct contact, and may have one or more plies of the material between the first end and the second end. At least initially during wrapping, at the overlapping portions the thickness of the material sheet may cause the non-linear edge (or the opposite edge) to form a raise edge, or lip, or a discontinuity of the exterior surface of the base sleeve. In most embodiments, the discontinuity at the edge dissipates or smoothes itself upon one or more of the subsequent steps of wrapping of additional sheets, and/or compression molding or wrapping with tape the base sleeve to cure, and/or curing. The edge could also be removed by grinding.

The sheet of material is wrapped onto a cylindrically-shaped support member to shape the sheet into a cylindrical base sleeve. In some embodiments, wrapping a sheet of material around a cylindrical support member forms an axial seam that is parallel to a longitudinal axis of the base sleeve being formed (and a longitudinal axis of the cylindrical support member). In other embodiments, wrapping a sheet of material around the support member forms an axial seam that is skewed to the longitudinal axis of the cylindrical-shape of the base sleeve being form (and a longitudinal axis of the cylindrical support member). In yet other embodiments, wrapping a sheet of material that is a strip or web around the support member wraps more than one time forming two or more plies of the sheet material in a jelly-roll manner, before portions of the first end and the second end are overlapped to form the seam. In general for the embodiments described above, the sheet of material has a leading end and a trailing end which are equivalent to the first end and the second end, in which at least one of the leading end and the trailing end has the non-linear edge. In still other embodiments, wrapping a sheet of material that is a strip or web around the cylindrical support member forms a helical seam about the cylindrically-shaped base sleeve being formed. In this embodiment, the sheet of material has extended side ends which are equivalent to the first end and the second end, in which at least one of the side ends has the non-linear edge.

After cutting a sheet of the material sufficient to form at least one layer wrapped about the cylindrical support member, the method includes wrapping the sheet of material on the support member to form a seam of the first end and the second end with the particular seam configuration according to the present invention. The steps of cutting and wrapping with additional sheets of material can be repeated as needed so as to build up the thickness sufficient for the base sleeve to have the desired wall thickness after curing. Additional sheets of material can also be added to the sheet that formed the initial wrapped ply to provide strength to the base sleeve necessary to withstand one or more expansions and contractions for mounting and dismounting of the print form on a printing cylinder with compressed air. If not already impregnated in the sheet of material, the resin may be applied after each sheet is wrapped or after all sheets are wrapped. A method of fabricating the cylindrically-shaped element by wrapping a sheet onto a cylindrically-shaped support member is sometimes referred to as a roll forming process.

If more than one sheet of material is needed to reach the desired wall thickness or strength for the base sleeve, the seam formed by each material sheet subsequently wrapped is circumferentially offset from the seam formed by the underlying sheets. That is, the seam/s of subsequently applied material sheet/s should not be located directly above any seam formed by the underlying material sheets. The seam formed by subsequent material sheet/s maybe offset by at least a circumferential width of the discontinuous seam region from the seam/s formed by the underlying material sheet/s, wherein the circumferential width is at least the amplitude of the non-linear edge. In most embodiments, the seams of the individual sheets are equally or substantially equally circumferentially-spaced about the base sleeve. Embodiments forming a base sleeve of two sheets, the seam of the second sheet can be offset by about 180 degrees from the seam of the first sheet. In embodiments forming a base sleeve of three sheets, the seams of each sheet can be offset by about 120 degrees from each other.

Figure 5:
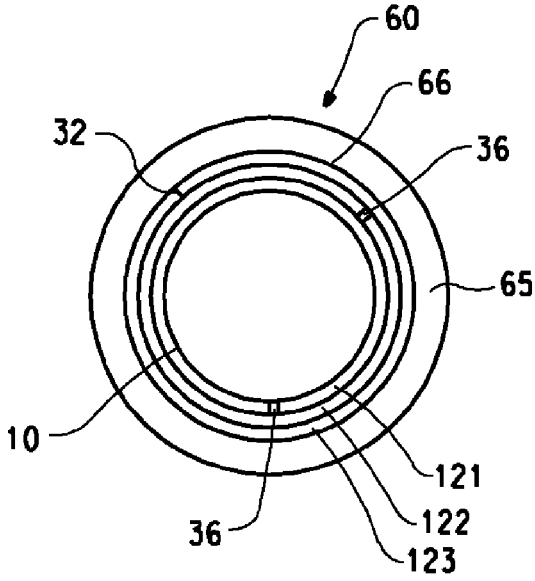
FIG. 5 is a schematic cross-sectional view of one embodiment of a cylindrical print element that includes one embodiment of a base sleeve having multiple layers or plies of sheet material in which each sheet forms an axial seam, the print element including a continuous layer of an imageable material disposed above an exterior layer of the base sleeve.

In some embodiments in which the base sleeve is formed of more than one ply or sheet of material, each sheet can have the period or width of the wave or waves forming the non-linear edge that is the same or different. In some embodiments, each sheet may be cut to have different period of the wave or waves relative to the side edge of the base sleeve being formed. In some other embodiments each sheet can be axially positioned such that the period of the wave or waves is at a different location along the axial length of the base sleeve, relative to the side edge of the base sleeve. By each sheet having the non-linear edge cut with different periods and/or offsetting the axial position of the period of the wave or waves, a base sleeve is formed in which the overlap portions and the gap portions that form the seam of each ply in the base sleeve are axially distributed to avoid excessive buildup of material in cross-section of the sleeve. FIG. 5 shows one cross-sectional view of one embodiment of a base sleeve having multiple sheets of material in which each sheet forms a ply with an axial seam, in which each of plies 121 and 122 has gap portion 36, and ply 123 has an overlap portion 32, such that the axial position of at least one of the overlap portions of the ply 123 is offset (and creates the gap portion 36) from the axial position of the axial position of at least one of the overlap portions of plies 121 and 122. Upon compression molding and/or curing of the base sleeve, the overlap portion 32 of ply 123 compresses and conforms to the mold to have a slight bump, and so for simplicity in FIG. 5 the overlap portion 32 appears butted.

After a sheet or a sufficient number of sheets of material are wrapped onto the support member to attain desired wall thickness for the cured base sleeve, the uncured base sleeve is cured to form a base sleeve suitable for use in printing. The uncured based sleeve may also be compressed during curing, to essentially mold the sleeve and aid in shaping and uniformity of the sleeve. The base sleeve is cured, that is, toughened or hardened by heating and/or exposing to actinic radiation to crosslink or polymerize the resin material. Curing conditions are highly dependent upon the resin selected, and one of ordinary skill in the art would understand that resins in a composite material are heat cured in an oven that is capable of ramping to a desired peak temperature, and maintaining the base sleeve at the temperature for a period of time.

Compression of the one or more sheets of material on the cylindrical support member to mold the base sleeve is not limited and can be accomplished by various methods. In most embodiments in which the base sleeve is cured by heating, the sheet of material is compressed between a support member and another outer member generally surrounding the exterior surface of the layer/s forming the base sleeve. In some embodiments the cylindrical support member expands relative to the outer member that does not expand (or expands less than the support member) and thus enables compression of the one or more layers of sheet material during curing to form the base sleeve. In this embodiment, the outer member can include one or more layers of a removable non-expandable tape, one or more layers of a removable shrink-wrap tape, or a spring steel form that clamps about the layers of sheet material. A silicon tube that fits over the layer/s of sheet material on the cylindrical support member can also be used for curing in an autoclave at high pressure. In another embodiment, the outer member can be a precision-ground cavity and an inflatable silicone tube can be the cylindrical support member, which is inflated to press the sheet/s of material against the cavity walls during curing. In yet another embodiment, the sheet/s of material can be compression molded between a rigid mandrel and a rigid cavity. Compression molding during heating may also help to minimize or prevent the formation of bubbles and/or pores in the resin material as the material cures, such that the sleeve can be more effectively mounted onto print cylinders with pressurized air. The expansion during heating and subsequent contraction upon cooling of the support member, also aids with extracting the base sleeve from the support member after cure. Under heat of curing and/or pressure from compression molding resin may flow and fill in-part or whole the gap/s between the first end and the second end in the discontinuous seam region.

Due to the flexibility in preparing base sleeves having a variety of diameters and lengths, and the advantages in minimizing investment in molds of the outer members, in most embodiments the sheet/s of material are compression molded between a cylindrical support member made of metal, such as aluminum, that has the capability to sufficiently expand during heating and contract upon cooling (to room temperature), and an outer member that can be one or more layers of a removable non-expandable tape or one or more layers of a removable shrink-wrap tape. A shrink-wrap tape is one that contracts upon heating, and thus can aid in the compression molding of the sheet/s of material into a base sleeve. The tape is wrapped about the exterior layer of the sheet/s of material, optionally under tension, in one or more layers at a density suitable to maintain compression of the sheet/s of material against the expansion of the cylindrical support member during curing. The tape should be capable of maintaining its integrity as an outer mold member during curing. Materials suitable as tape include, but are not limited to, films of polypropylene, polyethylene, polyester, and nylon. Combinations of tapes may be used to take advantage of particular properties, such as strength or release from base sleeve after cure, of each type of tape. As such, the outer mold member composed of wrapped tape includes embodiments in which one type of tape is wrapped in one or more layers, and embodiments in which two or more types of tape may be separately wrapped in one or more layers, about the exterior surface of the uncured base sleeve. In most embodiments, the sheet/s or material are cured immediately or substantially immediately after the outer member of tape warp is applied.

After curing the resin, the outer member, which in some embodiments is a film tape material, is removed from the base sleeve. The seam/s formed by each sheet of material in the cured base sleeve should not be substantially weaker than the remainder (i.e., bulk or non-seam portions) of the base sleeve. The cured base sleeve composed of a composite material of fiberglass and an epoxy resin has a modulus of elasticity of about $1.0\times10^6$ to about $6.0\times10^6$ pounds per square inch; and, a tensile strength of about 20,000 to about 70,000 pounds per square inch, measured at break. Both the modulus of elasticity and the tensile strength are conducted according to the standard test method described by ASTM D638-03, with modifications as follows. Cold pressed cardboard tabs are attached to the tab area of the tensile coupon using a cyanoacrylate-based glue (Super Glue®) to prevent breaks in the coupon from stress concentrations caused by the grips. The base sleeve is cut into a sample coupon having dimensions (as defined in the test specimen diagram on page 4 of the standard) as follows: W (width of narrow section) 0.375 inch (0.953 cm); L (length of narrow section) 1.5 inch (3.81 cm); WO (width overall) 0.5 inch (1.27 cm); and, LO (length overall) 5.25 inch (13.34 cm). A dynamic extensometer, 1.0 inch (2.54 cm), and strain-gage-based is used for all strain measurements. The crosshead speed is 0.2 inch per minute (0.51 cm per minute). An instrument suitable for testing modulus of elasticity and tensile strength is Instron® model 1125, running with MTS® Testworks® software (from Instron, Norwood, Mass.).

Although time and the complexity to the method of making the cylindrical elements is increased, some embodiments may require one or more additional treatments to the exterior surface of the base sleeve to assure desired performance of the base sleeve in end use. One example of an additional treatment to the exterior surface prior to application of the imageable material is grinding to assure uniform wall thickness. Grinding with a grinding stone or belt sander is well known to those skilled in the art of base sleeves and printing sleeves. Grinding may also assist in providing the base sleeve with the desired dimensions, particularly wall thickness and/or uniformity. Another example of a treatment to the exterior surface is applying an adhesive material, or double-sided tape, or undergoing an adhesion-promoting treatment, such as electron-treating, to assure that the imageable material will be secured to the base sleeve. Another example of a treatment to the exterior surface of the base sleeve is abrasive blasting or grit blasting which forcibly propels a stream of abrasive material against the exterior surface under high pressure to smooth a rough surface or roughen a smooth surface. Optionally, a layer of compressible material may be disposed above the exterior surface of the base sleeve prior to the application of the imageable layer.

An adhesive material, typically applied as a layer on the exterior surface of the base sleeve, should have a uniform thickness and be defect free. The adhesive material can be applied by any method including dip coating, slot coating, spray coating, roller coating, and doctor blading. Non-uniform application of the adhesive material can alter the transmission of the actinic radiation during exposure or appear as density variation/s particularly after back exposure (through the support and adhesive layer) in the continuous printing form. Density variation/s in the printing form may actually cause or may provide the perception that the form will not print as desired. Sometimes bubbles can even form in the adhesive layer as a result of temperatures and/or solvents used to convert the continuous printing element into a continuous relief printing form. Bubbles or other such defects in the applied adhesive layer cause loss of adhesion of the photopolymer layer. Impression on press during printing can cause the bubbles in the adhesive layer to become larger such that the photopolymer layer may lift in part or in whole from the continuous printing form. Additionally, bubbles in the adhesive layer can cause non-uniformities in printing areas resulting in missed printing. It is also possible that bubbles in the photopolymer layer can materialize on an exterior surface of the photopolymer layer after grinding.

The base sleeve has a wall thickness that can be from about 0.005 to about 0.100 inch (0.125 to 2.5 mm). In some embodiments, the wall thickness of the base sleeve is about 0.008 to about 0.020 inch (0.2 to 0.5 mm). In other embodiments, the base sleeve has a wall thickness of about 0.020 to 0.035 inch (0.2 to 0.875 mm). The wall thickness may be adjusted to accommodate different diameter sleeves. Generally, a preferred wall thickness is dependent upon the desired end-use conditions. The present method is not limited by a diameter of the base sleeve that can be made. In some embodiments, the base sleeve can have a diameter of about 3.0 to about 20.0 inch (about 7.62 to about 50.8 cm). In other embodiments, the base sleeve can have a diameter of about 3.5 to about 16.0 inch (about 8.89 to about 40.64 cm). In yet other embodiments, the base sleeve can have a diameter of about 3.8 to about 11.0 inch (about 9.65 to about 27.94 cm).

Cylindrical printing forms are sized according to the Bare Cylinder Diameter (BCD) which identifies printing press cylinder sizes for which the printing forms are intended. Sometimes adapters are mounted onto the printing press cylinder to accommodate different substrates that are being printed and/or different repeats of a printed image (so as to avoid purchase of new press cylinders). The present method easily accommodates preparing base sleeves having different wall thicknesses to accommodate flexibility of the base sleeve (for the printing form) that is needed during printing. Base sleeves having thin wall thicknesses (e.g., about 0.010 to about 0.020 inch (about 0.0254 to about 0.051 cm)) can be made by the present method to provide the desired flexibility when mounted on cushioned or flexible print adapters. Base sleeves having thicker wall thickness (e.g., about 0.025 to about 0.035 inch (about 0.064 to about 0.089 cm) can be made by the present method for use with hard or rigid print adapters.

One embodiment of a seam formed by wrapping a sheet of material 12 to form a base sleeve 10 is shown in FIG. 1. The sheet 12 includes a first end 14 having a non-linear edge 15 with amplitude 16 which creates a plurality of waves, i.e., a waveform, and a second end 24 having a linear edge 25 to form a seam 30. The non-linear edge 15 of the first end 14 includes portions 32 that overlap the second end 24. The seam 30 is a discontinuous seam since it includes the overlapping portions 32 of the first and second ends 14, 24 and gap portions 36 between the first and second ends. In the embodiment shown, portions of the amplitude 16 of the first end 14 that are disposed above and in contact with the second end 24 create the overlapping portions 32. The seam 30 runs parallel to a longitudinal axis of the cylindrical-shape of the base sleeve 10 (and a cylindrically-shaped support member which is not shown).

Figure 2:
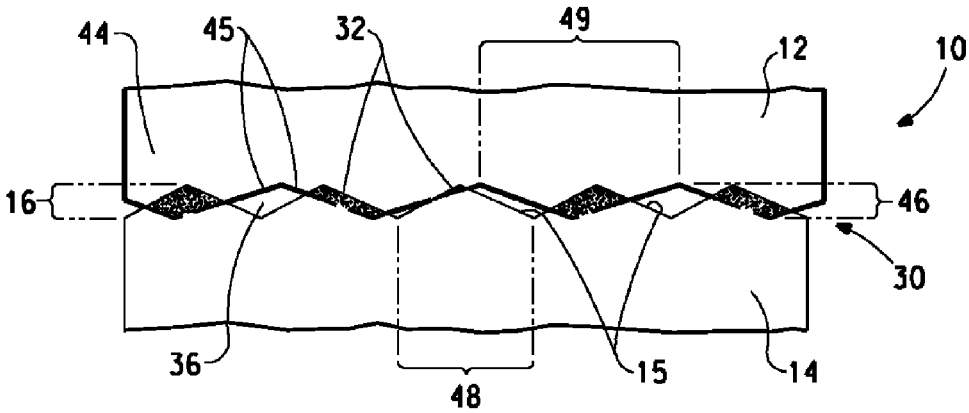
FIG. 2 is a schematic planar top view of one embodiment of a seam created to form a base sleeve for a cylindrically-shaped element from a sheet having a first end with a non-linear edge and a second end with a non-linear edge, wherein portions of the first end and the second end overlap, and the non-linear edge of the first end forms a waveform that has a period different than a waveform formed by the non-linear edge of the second end.

Another embodiment of a seam formed by wrapping a sheet of material 12 to form a base sleeve 10 is shown in FIG. 2. The sheet 12 includes a first end 14 having a non-linear edge 15 creating a plurality of waves, i.e., waveform, having amplitude 16 that contacts and overlaps portions of a second end 44 having a non-linear edge 45 with a plurality of waves, i.e., a waveform, to form the seam 30. As shown, the amplitude 16 of the first end 14 is the same or substantially the same as an amplitude 46 of each of the plurality of waves of the second end 44. In other embodiments (not shown) the amplitude 16 of the first end 14 can be different or substantially different from the amplitude 46 of the second end 44. Each wave of the waveform of the second end 44 has a period 48 or repeat that is different from a period 49 or repeat of each of the waves of the waveform on the first end 14. The seam 30 is a discontinuous seam because it includes overlapping portions 32 of the first and second ends 14, 44 and gap portions 36 between the first and second ends. In the embodiment shown, portions of the amplitude 16 of the first end 14 that are disposed above and in contact with the second end 44 create the overlapping portions 32. The seam 30 runs parallel to a longitudinal axis of the cylindrical-shape of the base sleeve 10 (and a cylindrically-shaped support member which is not shown).

Figure 3:
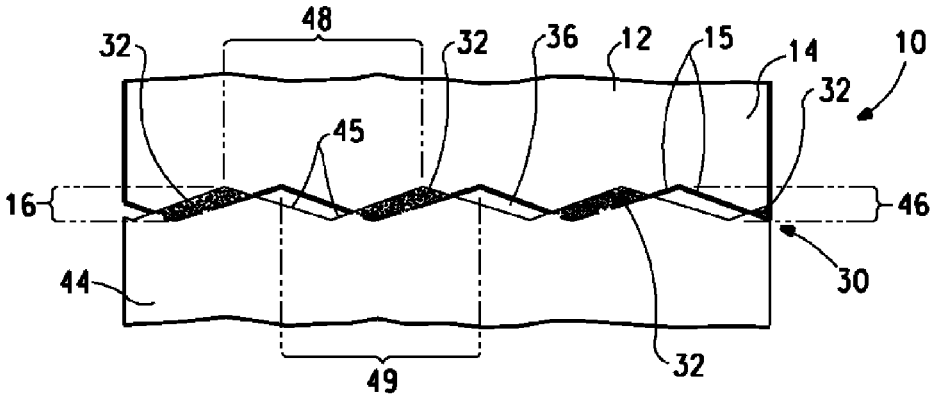
FIG. 3 is a schematic planar top view of another embodiment of a seam created to form a base sleeve for a cylindrically-shaped element from a sheet having a first end with a non-linear edge and a second end with a non-linear edge, wherein portions of the first end and the second end overlap, and the non-linear edge of the first end forms a waveform that is out-of-phase with a waveform formed by the non-linear edge of the second end.

Another embodiment of a seam formed by wrapping a sheet of material 12 to form a base sleeve 10 is shown in FIG. 3. The sheet 12 includes a first end 14 having a non-linear edge 15 of a plurality of waves, i.e., waveform, having amplitude 15 that overlaps portions of a second end 44 having a non-linear edge 45 with a plurality of waves, i.e., waveform. The waves of the waveform of the first end 14 and the waves of the waveform of the second end 44 have the same or substantially the same period 49, 48 or repeat, but the waveform of the first end 14 are offset from the waveform of the second end 44 when the first and second ends are adjacent and form the seam 30. The seam is a discontinuous seam because it includes overlapping portions 32 of the first and second ends 14, 44 and gap portions 36 between the first and second ends. In the embodiment shown, portions of the amplitude 16 of the first end 14 that are disposed below the second end 44 create the overlapping portions 32. The seam 30 runs parallel to a longitudinal axis of the cylindrical-shape of the base sleeve 10 (and a cylindrically-shaped support member which is not shown).

Figure 4A:
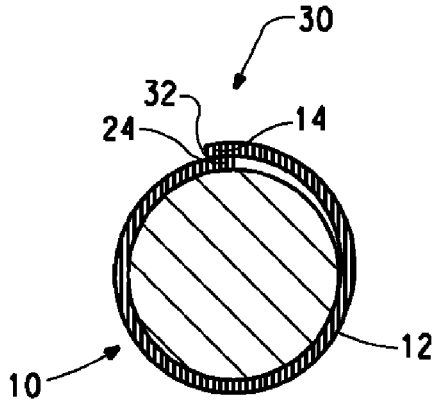
FIG. 4A is a schematic cross-sectional portion view of one embodiment of a base sleeve formed from a sheet of material having a first end and a second end wrapping on a cylindrically-shaped support member to form a seam with the portion showing the first end overlapping a portion of the second end.
Figure 4B:
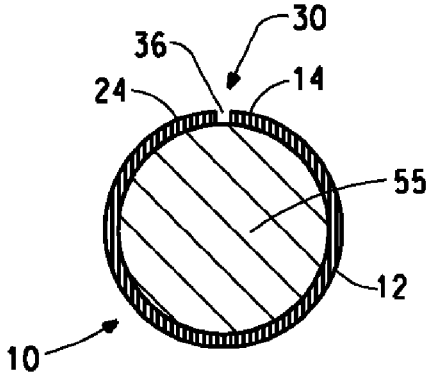
FIG. 4B is a cross-sectional portion view, which is adjacent the cross-sectional portion view shown in FIG. 4A, of one embodiment of a base sleeve formed from a sheet of material having a first end and a second end wrapping on a cylindrically-shaped support member to form a seam with the portion showing a gap between the first end and the second end.

Substantially adjacent cross-sectional portions of one embodiment of a base sleeve 10 formed by sheet of material 12 wrapped about a cylindrical support member 55 is shown in FIG. 4A and FIG. 4B. The seam 30 includes portions in which the amplitude of the non-linear edge 15 of the first end 14 of the sheet material 12 overlaps the second end 24 of the sheet, forming the overlapped portion 32 as shown in FIG. 4A. As depicted, the overlapped portion 32 is representative (though somewhat exaggerated) of the sheet material after wrapping to form the discontinuous seam, but prior to compression molding and/or curing. The seam 30 also includes portions in which the first end 14 and the second end 24 of the sheet material 12 do not overlap or contact, and form a gap or the gap portion 36 between the adjacent ends, as shown in FIG. 4B.

The present method of preparing the base sleeve has several advantages. The base sleeve can be easily and quickly prepared. Assembly of the base sleeve is simplified since sheet/s of material can easily be cut to size with at least one end having a non-linear edge and the first and second ends forming seam do not have to mate or align exactly or uniformly. A plurality of sleeves can be easily and quickly assembled in a plurality of different diameters, wall thicknesses, and lengths by forming one or more discontinuous seams that partially overlap between the non-linear end and the opposite end of the sheet/s of material. Base sleeves can have a more consistent appearance sleeve-to-sleeve which can provide for increased customer acceptance. Surprisingly and unexpectedly, the base sleeve prepared by the present method creates a discontinuous seam having one or more overlapping portions and one or more gap portions that minimizes or eliminates print through of the seam to the printed image. No print through of the seam is particularly advantages for sleeves having an imageable material of a continuous photopolymer layer having a thickness that is less than about 0.074 inch (0.19 cm). A discontinuous seam does not necessarily disrupt and can allow for a floor to be suitably formed in an imageable layer upon exposure to actinic radiation through the hollow side of the base sleeve. The presence of a discontinuous seam in a base sleeve for a print form does not impact the formation of an image in the print form. The base sleeve prepared according to the present method has the dimensional tolerances and wall thickness that is uniform or substantially uniform such that a subsequent grinding step can be avoided. The base sleeve prepared by the present method may have no or minimal waviness such that a pattern of winding the sheet material cannot be detected and provides a more uniform impression, at kiss impression and at normal impression, on press. The base sleeve is able to withstand air pressure necessary for mounting and demounting from a print cylinder. The method can also include applying an imageable material adjacent the exterior surface of the base sleeve that covers at least a portion of the axial seam. In one embodiment, a printing plate having a surface suitable for printing may be secured or mounted to or disposed above an exterior surface of the cylindrically-shaped element or base sleeve, and thereby considered a cylindrically-shaped printing form. In another embodiment, a printing plate precursor having an imageable material which can be rendered suitable for printing can be disposed above an exterior surface of the base sleeve, and thereby considered a cylindrically-shaped element or printing form precursor. The positioning of the plate or plates on the base sleeve relative to the seam location/s is not limited, and can, for instance, be secured across a seam of the base sleeve. In another embodiment, a continuous or substantially continuous layer of an imageable material can be applied to or disposed above an exterior surface of the base sleeve, and thereby considered a cylindrically-shaped print form precursor. Applying an imageable material adjacent the exterior surface of the base sleeve encompasses all described embodiments including securing one or more plates, applying a photosensitive material as a precursor material on the base sleeve, applying a rubber material on the base sleeve, and alternate embodiments conventional in the flexographic printing art. In most embodiments, the imageable material covers at least a portion of the axial seam.

FIG. 5 is a cross-sectional view of one embodiment of a cylindrical print element 60 having a continuous layer 65 of an imageable material disposed above an exterior surface 66 of the base sleeve 10. The cylindrical print element 60 in this instance is a print precursor, i.e., continuous layer is yet to be imaged and may be considered a photopolymerizable material. In the embodiment shown, the base sleeve 10 includes three layers 121, 122, 123 of sheets of material 12, each sheet forming an axial or substantially axial, discontinuous seam 30 composed of the first end 14 and the second end 24 (or 44) of the sheet. Each discontinuous seam 30 includes overlapping portions 32 of the first and second ends 14, 24 and gap portions 36 between the first and second ends of the sheet of material. The imageable material forms a continuous layer 65 having no seams itself and covers the discontinuous seams 30 formed in the underlying base sleeve 10. For simplicity, a floor formed in the continuous layer 65 of the photopolymerizable material, and any layer/s intermediate the continuous layer 65 and the base sleeve 10, such as an adhesive layer, are not shown.

A photosensitive material can be applied to the base sleeve to form a continuous or substantially continuous layer of the photosensitive material and form a continuous printing element or continuous print form. In most embodiments, the continuous photopolymer layer is seamless. The formation of seamless, continuous printing elements can be accomplished by several methods. The photopolymerizable flat sheet elements can be reprocessed by wrapping the photopolymerizable sheet element around the base sleeve, and then heating to join the edges of the photopolymerizable sheet together to form a seamless, continuous element. Processes for joining the edges of a plate into a cylindrical form have been disclosed, for example, in German patent DE 28 44 426; United Kingdom patent GB 1 579 817; U.S. Pat. Nos. 4,883,742; 4,871,650; US Pub. No. 2006/0249239; EP 0 469 375; EP 2 026 132 A2; and EP 2 154 572 A2. These processes can take extended periods of time to completely form the cylindrical printing element since the photopolymerizable sheet is heated to bring the sheet up to a temperature sufficient to join the edges. Another method of disposing an imageable layer on a base sleeve is by centrifugally depositing a liquid photosensitive composition on a cylindrical support as disclosed in U.S. Pat. No. 4,868,090. Yet other methods of forming a continuous imageable layer on the base sleeve include applying a stream or sheet of molten photopolymerizable material and calendering the molten material to form a uniform layer on a cylindrical support as disclosed in U.S. Pat. Nos. 5,798,019; 5,916,403; and 6,425,327.

The method for making a cylindrically-shaped element may include a back exposure or backflash step, which is a blanket exposure to actinic radiation through the base sleeve (i.e., with the source of actinic radiation from a hollow portion of the base sleeve). It is used to create a layer of polymerized material, or a floor, on the base sleeve side of the photopolymerizable layer and to sensitize the photopolymerizable layer. Any of the conventional radiation sources discussed for the overall (imagewise) actinic radiation exposure step can be used for the backflash exposure step. Exposure time generally range from a few seconds up to a few minutes. At least 15% of actinic radiation is transmitted through the base sleeve, and exposure time may need to be accordingly adjusted. The backflash exposure can occur during manufacture of the precursor (i.e., cylindrical photopolymerizable blank) and/or during the preparation of the printing form from the cylindrical precursor blank. Other methods of creating the floor are also possible in essence by applying a layer of photopolymerizable material onto a support, exposing the applied layer to actinic radiation, and then applying another layer of photopolymerizable material on the cured exposed layer as disclosed in US Pub. No. 2005/0250043 A1; US Pub. No. 2005/0277062 A1; U.S. Pat. Nos. 4,869,997; 6,966,259; and 7,081,331.

Printing plates, as either precursors or as a print form having undergone steps to form the image to be printed, can be mounted on the base sleeve of the present invention. Print form of the present invention encompasses embodiments of a plate-on-sleeve system. Typically, plate-on-sleeve is a photosensitive element that includes at least the composition layer on a planar support, i.e., a plate, which is then mounted onto a cylindrically-shaped base sleeve. Ends of the plate may or may not meet or join when wrapped onto the sleeve. Plate-on-sleeve also includes an embodiment in which more than one plate, or portions of plates, are mounted onto a sleeve at various spaced locations. Conventionally, printing plates are mounted on the base sleeve using double-sided sticky back tape and/or with a cushioning tape.

Imageable Material

In embodiments in which an imageable material is disposed above the base sleeve, whether in plate form or as a photosensitive layer, the imageable material may be considered a photosensitive element. In most embodiments the photosensitive element or precursor includes at least one layer of a photopolymerizable composition. The term "photosensitive" encompass any system in which the at least one photosensitive layer is capable of initiating a reaction or reactions, particularly photochemical reactions, upon response to actinic radiation. In some embodiments, the photosensitive element includes a support for the photopolymerizable layer. In some embodiments, the photopolymerizable layer is an elastomeric layer that includes a binder, at least one monomer, and a photoinitiator. In some embodiments, the photosensitive element includes a layer of an infrared sensitive material which can also function as an actinic radiation opaque material adjacent the photopolymerizable layer, opposite the support.

Unless otherwise indicated, the term "photosensitive element" encompasses print precursors capable of undergoing exposure to actinic radiation and treating to form a surface suitable for printing. Unless otherwise indicated, the "photosensitive element" and "printing form" (or "print form") includes elements or structures in any form which become suitable for printing or are suitable for printing, including, but not limited to, photopolymeric layer/s, flat sheets, plates, and plates-on-carriers, and which are associated with the cylindrically-shaped base sleeve of the present invention. Even though in most embodiments a printing plate typically has already undergone the steps to convert a photosensitive plate element or precursor to a print plate having the image area suitable for printing, the printing plate or plate-on-carrier is still considered an imageable material disposed above the exterior surface of the base sleeve. It is contemplated that printing form resulting from the photosensitive element has end-use printing applications for relief printing, gravure-like printing, and gravure printing.

The photosensitive element includes at least one layer of a photopolymerizable composition. As used herein, the term "photopolymerizable" is intended to encompass systems that are photopolymerizable, photocrosslinkable, or both. The photopolymerizable layer is a solid elastomeric layer formed of the composition comprising a binder, at least one monomer, and a photoinitiator. The photoinitiator has sensitivity to actinic radiation, which includes ultraviolet radiation and/or visible light. The solid layer of the photopolymerizable composition is treated to form a relief suitable for flexographic printing. As used herein, the term "solid" refers to the physical state of the layer which has a definite volume and shape and resists forces that tend to alter its volume or shape. The layer of the photopolymerizable composition is solid at room temperature, which is a temperature between about 5° C. and about 30° C. The photosensitive element includes embodiments in which the photosensitive element has not been exposed to actinic radiation, and the photosensitive element has been exposed to actinic radiation. As such the photosensitive element can include embodiments in which the layer of the photopolymerizable composition includes unpolymerized portion/s; or polymerized portion/s (i.e., photohardened or cured); or both polymerized portion/s and unpolymerized portion/s.

The binder is not limited and can be a single polymer or mixture of polymers. In some embodiments, the binder is an elastomeric binder. In other embodiments, the binder becomes elastomeric upon exposure to actinic radiation. Binders include natural or synthetic polymers of conjugated diolefin hydrocarbons. In some embodiments, the binder is an elastomeric block copolymer of an A-B-A type block copolymer, where A represents a non-elastomeric block, and B represents an elastomeric block. The non-elastomeric block A can be a vinyl polymer, such as for example, polystyrene. Examples of the elastomeric block B include polybutadiene and polyisoprene. The binder is at least soluble, swellable, or dispersible in organic solvent washout solutions.

Either a single elastomeric material or a combination of materials can be used for the elastomeric layer so long as the characteristics desired for relief printing are obtained. Examples of elastomeric materials are described in *Plastic Technology Handbook*, Chandler et al., Ed., (1987). In many cases it may be desirable to use thermoplastic elastomeric materials to formulate the elastomeric layer. When a thermoplastic elastomeric layer is reinforced photochemically, the layer remains elastomeric but is no longer thermoplastic after such reinforcement. This includes, but is not limited to, elastomeric materials such as copolymers of butadiene and styrene, copolymers of isoprene and styrene, styrene-diene-styrene triblock copolymers.

The photopolymerizable composition contains at least one compound capable of addition polymerization that is compatible with the binder to the extent that a clear, non-cloudy photosensitive layer is produced. The at least one compound capable of addition polymerization may also be referred to as a monomer. Monomers that can be used in the photopolymerizable composition are well known in the art and include, but are not limited to, addition-polymerization ethylenically unsaturated compounds with at least one terminal ethylenic group. The composition can contain a single monomer or a combination of monomers. Monomers can be appropriately selected by one skilled in the art to provide suitable elastomeric and other properties to the photopolymerizable composition.

The photoinitiator can be any single compound or combination of compounds which is sensitive to actinic radiation, generating free radicals which initiate the polymerization of the monomer or monomers without excessive termination. Any of the known classes of photoinitiators, particularly free radical photoinitiators may be used. Alternatively, the photoinitiator may be a mixture of compounds in which one of the compounds provides the free radicals when caused to do so by a sensitizer activated by radiation. Preferably, the photoinitiator for the main exposure (as well as post-exposure and backflash) is sensitive to visible or ultraviolet radiation, between 310 to 400 nm, and preferably 345 to 365 nm.

The photopolymerizable composition can contain other additives depending on the final properties desired. Additional additives to the photopolymerizable composition include sensitizers, plasticizers, rheology modifiers, thermal polymerization inhibitors, colorants, processing aids, antioxidants, antiozonants, dyes, and fillers.

The thickness of the photopolymerizable layer can vary over a wide range depending upon the printing end-use application. In some embodiments, the photosensitive layer can have a thickness from about 0.005 inch to about 0.250 inch or greater (0.013 to 0.64 cm or greater). In most embodiments, the thickness of the photopolymerizable layer is from about 0.045 inches to about 0.250 inches (about 0.025 cm to about 0.64 cm). In some embodiments, the thickness of the photopolymerizable layer is from about 0.045 inch to about 0.112 inch (about 0.025 cm to about 0.28 cm).

In some embodiments where a plate is disposed above an exterior surface of the base sleeve, the plate or photosensitive element can include a support adjacent the layer of the photopolymerizable composition. The support can be composed of any material or combination of materials that is conventionally used with photosensitive elements used to prepare printing forms. In some embodiments, the support has a thickness from 0.002 to 0.050 inch (0.0051 to 0.127 cm).

As is well known to those of ordinary skill in the art, the photosensitive element may include one or more additional layers adjacent the photopolymerizable layer, that is, on a side of the photopolymerizable layer opposite the support or base sleeve. Depending on desired use, the additional layers may be opaque or transparent to actinic radiation, and may have one or more functions for the photosensitive element. The additional layers include, but are not limited to, a release layer, an elastomeric capping layer, a barrier layer, an adhesion modifying layer, a layer which alters the surface characteristics of the photosensitive element, and combinations thereof. The one or more additional layers can be removable, in whole or in part, during treatment. One or more of the additional layers may cover or only partially cover the photosensitive composition layer. It is well within the ordinary skill of those in the art to select and prepare additional layers on the photopolymerizable layer according to desired end-use. The photosensitive printing element of the present invention may further include a temporary coversheet on top of the uppermost layer of the element.

In some embodiments, the photosensitive element can be exposed to actinic radiation before treating. The process of preparing a printing form from a photosensitive element usually (but not always) includes a back exposure or backflash step. This is a blanket exposure to actinic radiation through the support. It is used to create a layer of polymerized material, or a floor, on the support side of the photopolymerizable layer and to sensitize the photopolymerizable layer. The backflash exposure can take place before, after or during the other imaging steps. Any of the conventional radiation sources discussed for the overall (imagewise) actinic radiation exposure step can be used for the backflash exposure step. Exposure time generally range from a few seconds up to a few minutes.

Upon imagewise exposure, the radiation-exposed areas of the photopolymerizable layer are converted to the insoluble state with no significant polymerization or crosslinking taking place in the unexposed areas of the layer. Any conventional source of actinic radiation can be used for this exposure. The radiation sources generally emit long-wave UV radiation between 310-400 nm. The exposure time may vary from a few seconds to minutes, depending upon the intensity and spectral energy distribution of the radiation, its distance from the photosensitive element, and the nature and amount of the photopolymerizable material.

As is well-known to those skilled in the art, imagewise exposure can be carried out by exposing the photosensitive element through an image-bearing photomask that can be a separate film, i.e., an image-bearing transparency or phototool, or be integrated with the photosensitive element as an in-situ mask formed by computer-to-plate digital imaging.

Following imagewise exposure to actinic radiation through the mask and removal of the photomask if it is a separate film, the photosensitive printing element is treated with a washout solution or heat to remove unpolymerized areas in the photopolymerizable layer and thereby form a relief image. Treating step removes at least the photopolymerizable layer in the areas that were not exposed to actinic radiation, i.e., the unexposed areas or uncured areas, of the photopolymerizable layer. Except for the elastomeric capping layer, typically the additional layers that may be present on the photopolymerizable layer are removed or substantially removed from the polymerised areas of the photopolymerizable layer. For photosensitive elements including a separate IR-sensitive layer for digital formation of the mask, the treating step that forms the relief image in the photopolymerizable layer may also remove the mask image (which had been exposed to actinic radiation).

Treating of the photosensitive element includes (1) "wet" development wherein the photopolymerizable layer is contacted with a suitable developer solution to washout unpolymerized areas and/or (2) "dry" development wherein the photosensitive element is heated to a development temperature which causes the unpolymerized areas of the photopolymerizable layer to melt or soften or flow and then are removed. Dry development may also be called thermal development. It is also contemplated that combinations of wet and dry treatment can be used to form the relief.

Wet development can be carried out at room temperature but usually is carried out at about 80 to 100° F. The developers can be organic solvents, aqueous or semi-aqueous solutions, and water. The choice of the developer will depend primarily on the chemical nature of the photopolymerizable material to be removed. Development time can vary based on the thickness and type of the photopolymerizable material, the solvent being used, and the equipment and its operating temperature, but it is preferably in the range of about 2 to about 25 minutes. Developer can be applied in any convenient manner, including immersion, spraying and brush or roller application. Brushing aids can be used to remove the unpolymerized portions of the element. Washout can be carried out in an automatic processing unit which uses developer and mechanical brushing action to remove the uncured portions of the plate, leaving a relief constituting the exposed image and the floor. Following treatment by developing in solution, the relief printing plates are generally blotted or wiped dry, and then more fully dried in a forced air or infrared oven.

Treating the element thermally includes heating the photosensitive element having at least one photopolymerizable layer (and the additional layer/s) to a temperature sufficient to cause the uncured portions of the photopolymerizable layer to liquefy, i.e., soften or melt or flow, and removing the uncured portions. The layer of the photosensitive composition is capable of partially liquefying upon thermal development. That is, during thermal development the uncured composition must soften or melt at a reasonable processing or developing temperature. If the photosensitive element includes one or more additional layers on the photopolymerizable layer, the one or more additional layers should also removable in the range of acceptable developing temperatures for the photopolymerizable layer. The polymerized areas (cured portions) of the photopolymerizable layer have a higher melting temperature than the unpolymerized areas (uncured portions) and therefore do not melt, soften, or flow at the thermal development temperatures. The uncured portions can be removed from the cured portions of the composition layer by any means including air or liquid stream under pressure as described in U.S. publication 2004/0048199 A1, vacuum as described in Japanese publication 53-008655, and contacting with an absorbent material as described in U.S. Pat. Nos. 3,060,023; 3,264,103; 5,015,556; 5,175,072; 5,215,859; 5,279,697; and 6,797,454. A preferred method for removing the uncured portions is by contacting an outermost surface of the element to an absorbent surface, such as a development medium, to absorb or wick away or blot the melt portions. A wide temperature range may be utilized to melt or soften the composition layer for removal. Absorption may be slower at lower temperatures and faster at higher temperatures during successful operation of the process.

The thermal treating steps of heating the photosensitive element and contacting an outermost surface of the element with development medium can be done at the same time, or in sequence provided that the uncured portions of the photopolymerizable layer are still soft or in a melt state when contacted with the development medium. The at least one photopolymerizable layer (and the additional layer/s) are heated by conduction, convection, radiation, or other heating methods to a temperature sufficient to effect melting of the uncured portions but not so high as to effect distortion of the cured portions of the layer. The photosensitive element is heated to a surface temperature above about 40° C., preferably from about 40° C. to about 230° C. (104-446° F.) in order to effect melting or flowing of the uncured portions of the photopolymerizable layer. By maintaining more or less intimate contact of the development medium with the photopolymerizable layer that is molten in the uncured regions, a transfer of the uncured photosensitive material from the photopolymerizable layer to the development medium takes place. While still in the heated condition, the development medium is separated from the cured photopolymerizable layer in contact with the support layer to reveal the relief structure. A cycle of the steps of heating the photopolymerizable layer and contacting the molten (portions) layer with the development medium can be repeated as many times as necessary to adequately remove the uncured material and create sufficient relief depth. Typically the photopolymerizable element is thermally treated for 5 to 15 cycles.

EXAMPLES

The following example demonstrates the preparation of a cylindrically-shaped printing form having a base sleeve with an axial seam formed with a sheet of material having a non-linear edge. The base sleeve provides the mechanical support for the polymer on the printing form, making it capable of being mounted on and off a print cylinder with compressed air assist, and capable of printing with desirable image quality without print through of the seam.

Base Sleeve

A base sleeve was prepared as follows:

Material of construction was a woven fiberglass fabric that was impregnated with an epoxy resin (prepreg), purchased as a roll of sheet material from Advanced Composites Group (ACG) in Tulsa, Okla. A layer of an epoxy resin, type MTM59 (from AGC), was coated on a "120 style" fiberglass fabric to form the prepreg. The nominal resin content of the prepreg was 44% by weight. The prepreg stored and remained frozen at 0° F. (−17.8° C.), and was thawed just prior to fabricating a base sleeve.

The prepreg was placed on an X-Y cutting table, which allowed a more precise cutting dimension than cutting by hand. Once at room temperature, the prepreg was unrolled on an X-Y cutting table, and each of three sheets was cut to have at least one non-linear edge that will form an axial seam of the base sleeve. To achieve the desired strength and flexibility, three layers of prepreg were used to fabricate the base sleeve. Cutting patterns for the three pieces of prepreg were created as instructed by the manufacturer of the cutting table vendor. The shape of all three sheets was similar, with only a slight change in length to account for diameter change as additional layers were added. The pattern described as follows was repeated across the width of each piece. For this example, the width of the finished print form was 50 inches. The first sheet was cut to have a non-linear edge on the lead end that appears as a zigzag pattern of repeating waves; in which each wave has a period of 5 inch valley-to-valley (see FIG. 3, period 48) and amplitude of 0.2 inch measured perpendicular from peak to valley (see FIG. 3, amplitude 46). The second end of the first sheet was cut to have the same zigzag pattern of repeating waves as the first end, except that the start of the zigzag pattern on the first end is offset (out of phase) with the zigzag on the second end by 1.25 inch (3.175 cm). Each sheet was cut to a length as measured from a midpoint of the amplitude of the first end and a midpoint of the amplitude of the second end of each sheet. The first sheet was cut to length of 20.180 inch. The second sheet was cut to length of 20.217 inch. The third sheet was cut to length of 20.255 inch.

For this example, the base sleeves were fabricated to fit on a 6.435 inch (16.235 cm) diameter print cylinder, which is a standard quarter-pitch size in the printing industry. The base sleeve was formed around a cylindrical aluminum mandrel which has a diameter of 6.424 inches (16.317 cm); smaller than the diameter of the print cylinder because the mandrel expands during the thermal cycle required to cure the epoxy. The mandrel was prepared in a fashion typical in the composites industry with both a mold sealant and mold release prior to forming the base sleeve. The mandrel was the inner half of the mold that forms the base sleeve.

The zigzag pattern of the lead edge of the sheet forming Ply 1 was aligned axially along the length of the mandrel. Once aligned, the sheet was wrapped around the mandrel. The length of each ply was defined such that the resulting seam of the first end/second end, i.e., lead edge/trail edge, appears as shown in FIG. 3. In FIG. 3, the trail edge is shaded for identification. Since the zigzag on the lead edge was offset (out of phase) with the zigzag on the trail edge, the lead edge and the trail edge of the wrapped sheet formed an axial seam having alternating regions of overlap (i.e., contacting portions) and under lap (i.e., gap portions). The width of the under lap and the overlap were both about 0.1 inches (0.254 cm). The type of X-Y cutting table and the roll forming equipment used to wrap the prepreg around the mandrel were selected such that the variation is less than +/−0.1 inches (+/−0.254 cm) so that there are always regions of overlap and under lap.

The wrapping process was repeated individually for the second sheet forming Ply 2 and for the third sheet forming Ply 3 with the location of the respective seams spaced 120° apart around the circumference of the mandrel as shown in FIG. 5. After all three layers of prepreg were applied, multiple layers of a film tape were then wrapped around the 3 plies on the mandrel using a tape wrapping machine that is typical in the prepreg roll-forming industry. The tape was the outer half of the mold that forms the base sleeve. The taped mandrel was hung in a vertical oven and cured using the thermal cycle defined by ACG for the MTM59 epoxy resin system.

After cooling, the tape was removed and the tube slid off the mandrel. The fiberglass/epoxy composite tube had a 0.13 inch (0.33 cm) wall thickness that was suitable as a base sleeve and ready for application of the photopolymer. For simplicity, the base sleeve of the Example having seams formed of a non-linear edge with an amplitude and overlapping portions, is referred to as a zigzag pattern or zigzag seam.

For comparison purposes, similar base sleeves were made with straight seams. For the base sleeve of Comparative A, the length of each ply was increased by 0.020 inches (0.051 cm) to force the seams to have a nominal overlap, i.e., completely overlap leading end and trailing end along length of the seam. For the base sleeve of Comparative B, the length of each ply was decreased by 0.020 inches (0.051 cm) to force a nominal under lap, i.e., forming a gap between leading end and trailing end along the length of the seam. Such seams would be typical of a fabrication process for seams in which the lead and trail edges are intended to perfectly abut each other since typical manufacturing tolerances will result in variation. All other fabrication and processing parameters remained the same.

Photopolymerizable Cylindrically-Shaped Form

The base sleeve was mounted with air-assist onto a mandrel for preparing a cylindrically shaped photopolymerizable form. A CYREL® photopolymerizable material, type HORB (from DuPont, Wilmington, Del., USA), was applied to the base sleeve as a molten material and calendered as described in U.S. Pat. Nos. 5,916,403 and 5,798,019. Once cooled to room temperature, the nominal thickness of the photopolymerizable layer was 0.049 inches (0.124 cm). The photopolymerizable material is a composition that includes an elastomeric binder, monomer, photoinitiator, and additives, as is well-known to those of ordinary skill in the art. The photopolymerizable layer was calendered for a time sufficient such that a seamless photopolymerizable layer was formed on the base sleeve, i.e., the photopolymerizable layer was shaped into a uniform cylindrical layer surrounding the base sleeve. While the above method was used to form the cylindrical photopolymerizable layer on the base sleeve, the photopolymerizable material could be applied to the base sleeve by any other method known by those skilled in the art of cylindrical printing forms for flexography.

An infrared-radiation-sensitive, actinic-radiation-opaque layer as described in U.S. Pat. No. 6,238,837 was applied to the exterior surface of the cylindrical photopolymerizable layer by coating with the process as described in U.S. Pat. No. 6,531,184.

Cylindrical Printing Form

A cylindrical precursor composed of the base sleeve, the cylindrical layer of the photopolymerizable material, and the infrared layer was converted to a cylindrical printing form. An in-situ mask was formed by laser ablation of the infrared sensitive layer on the precursor using a CYREL® Digital Imager. The in-situ mask image was a target that included solids, line work, and various screen areas (5, 15, 30, 50, 70%) at 133 lines per inch. The screen areas of the mask covered the entire circumference of the print form and thus overlapped each of the three seams to accentuate any print defect caused by a seam.

The cylindrical precursor was exposed through the base sleeve on a custom-made exposure unit to ultraviolet radiation at 365 nm for an overall exposure through the base sleeve for 52 seconds. Then, the cylindrical precursor was imagewise exposed through the in-situ mask in air for six minutes using an exposure unit for cylindrical print forms as described in US patent publication US 2010/0321663 A1. The photosensitive elements were processed in a CYREL® solvent development apparatus using CYREL® Cylosol solvent developer at the conditions recommended for precursors having a 0.049 inch (0.124 cm) photopolymeric layer. The cylindrical precursor was developed to reach the relief depth of 0.018 inch (0.046 cm) forming the cylindrical printing form having a relief surface on the photopolymer layer that was suitable for printing. The cylindrical printing form from the precursor was post exposed and light-finished on a CYREL® Round Light-Finisher unit.

Printing of the Cylindrical Printing Form

The thus prepared cylindrical printing form was used to print images onto 1.5 mil white linear low density polyethylene mono-layer, one side treated substrate that was 40 inches (101.6 cm) wide. The cylindrical printing form was mounted with air assist onto a printing cylinder of a Paper Converting Machine Company (PCMC) Avanti central impression, 8 color, gearless, cantilevered press. A Harper 800/2.1 anilox roll was used to ink the cylindrical printing form with a cyan solvent flexographic ink (manufactured by Sun Chemical, order code DRSFS5133195/K525 PROCESS GS CYAN). Printing was done at 500 feet per minute, at both a "Kiss" and a "Kiss plus 0.002 inch" impression. Although the cylindrical print forms were 50 inches (127 cm) wide, the actual image was 34 inches (86.36 cm) and centered on the substrate. No problems with the compressed air mounting and dismounting of the printing forms of the Example and Comparatives were observed.

Two observers reviewed the print samples independently, each under different viewing conditions and noted the location of print defects that were detected by eye. The locations of the defects were compared to the actual location of the seams in the base sleeve, which could be determined by looking at the seams. The table below contains the defect counts that were associated with seams of the printing form for each observer.

| | Seam Type | Observer #1 | Observer #2 | Total |
|---|---|---|---|---|
| Example | Zigzag | 1 | 0 | 1 |
| Comparative A | Overlap | 1 | 4 | 5 |
| Comparative B | Under lap | 3 | 1 | 4 |

Observer #1 detected the fewest number of print defects associated with the base sleeve of the Example (zigzag pattern seam) and with the base sleeve of Comparative A (overlap seam). Observer #2 detected the least amount of print defects for the base sleeve of the Example. When the results are combined, the base sleeve of the Example having the zigzag seams, that is, seams with overlapping portions and non-contacting portions, showed significantly fewer print defects than the base sleeve of Comparative A having straight overlapped seams, and the base sleeve of Comparative B having straight gapped seams. Although the discontinuous seams of the base sleeve of the Example can be observed in the cylindrical printing form, their presence did not interfere with the exposure through the base sleeve to form the floor of the relief pattern, nor print through to the printed image.

The invention claimed is:

1. A method for making a cylindrically-shaped element for use as a printing form comprising:

a) providing a first sheet of a material having a first end and a second end opposite the first end;

b) wrapping the sheet to bring the second end adjacent the first end thereby forming the sheet into a base sleeve having an exterior surface and a seam of the first and second ends; and c) applying an imageable material adjacent the exterior surface that covers at least a portion of the seam;

wherein the first end forms a non-linear edge that has an amplitude and overlaps portions of the second end, and wherein the seam comprises one or more of the overlap portions and one or more non-contacting portions that form a gap between the first end and the second end.

2. The method of claim 1 wherein the applying step forms a continuous layer of the imageable material covering the seam.

3. The method of claim 1 wherein the material is a composite material comprising a fibrous material and a curable resin.

4. The method of claim 1 wherein the material is a composite material comprising a fabric material and a thermally-curable resin.

5. The method of claim 1 wherein the seam is a discontinuous seam comprising the overlap portion and one or more gap portions between the first end and the second end.

6. The method of claim 1 wherein the wrapping step comprises placing the sheet onto a cylindrically-shaped support and rotating the support to bring the second end and the first end adjacent.

7. The method of claim 1 wherein the non-linear edge comprises a waveform of a plurality of waves, each wave having an amplitude which can be the same or different.

8. The method of claim 1 wherein the non-linear edge comprises a waveform of a plurality of waves, each wave having a period width which can be the same or different.

9. The method of claim 1 wherein the seam is an axial seam of the second end in contact with at least a portion of the amplitude of the non-linear edge.

10. The method of claim 1 wherein the second end forms a linear edge.

11. The method of claim 1 wherein the second end forms a non-linear edge having an amplitude that is different from the amplitude of the first end.

12. The method of claim 1 wherein the non-linear edge comprises a waveform of a plurality of waves, each wave having an amplitude and a period width which are the same, and the second end has a non-linear edge comprising a waveform of a plurality of waves, each wave having an amplitude and a period that are the same or different as the amplitude and period of the first end.

13. The method of claim 12 wherein the period of the plurality of waves of the second end is out of phase with the period of the plurality of waves of the first end.

14. The method of claim 1 wherein 15 to 90% of the first end forms overlapping portions with the second end.

15. The method of claim 1 wherein the amplitude has a height equal to or greater than a print width that is created at a nip between the printing form mounted on a printing cylinder and an impression roll on a print press.

16. The method of claim 1 further comprising, prior to the applying step c):

bi) wrapping an additional sheet of a material having a first end and a second end onto the exterior surface of the base sleeve to bring the second end adjacent the first end of the additional sheet to form a seam of the additional sheet, wherein the first end of the additional sheet forms a non-linear edge that has an amplitude and overlaps portions of the second end of the additional sheet.

17. The method of claim 16 wherein the seam of the first sheet is an axial seam and the seam of the additional sheet is circumferentially offset from the axial seam.

18. The method of claim 16 wherein the base sleeve has an axial length and further comprises offsetting on the length an axial position of at least one of the overlap portions at the seam of the additional sheet from an axial position of the overlap portion of the seam of the first sheet.

19. The method of claim 16 further comprising repeating step bi) with one or more additional sheets of material on to an exterior surface of the previously wrapped sheet.

20. The method of claim 1 further comprising prior to the applying step c): wrapping a removable film about the exterior surface of the base sleeve, heating to cure the material, and removing the film.

21. The method of claim 20 wherein the removable film is a shrink-wrap film.

22. The method of claim 1 wherein the imageable material comprises a photosensitive material.

23. The method of claim 1 wherein the imageable material comprises a photopolymerizable composition of an elastomeric binder, at least one ethylenically unsaturated compound, and a photoinitiator.

24. The method of claim 1 further comprising after step c):

forming a printing surface from the layer of the imageable material; and mounting the printing form onto a printing cylinder of a print press;

wherein the amplitude has a height equal to or greater than print width created at a nip between the printing form and an impression roll on the print press.

25. The method of claim 1 further comprising, prior to applying step c): modifying the exterior surface of the base sleeve with a modification treatment selected from applying an adhesive material, grinding, or grit blasting.

26. A method for making a cylindrically-shaped base sleeve for use as a printing form comprising:

a) providing a first sheet of a material having a first end and a second end opposite the first end;

b) wrapping the sheet on a cylindrical support member to bring the second end adjacent the first end thereby forming the sheet into the base sleeve having an exterior surface and a seam of the first and second ends, wherein the first end forms a non-linear edge that has an amplitude and overlaps portions of the second end, forming the seam comprising one or more of the overlap portions and one or more non-contacting portions that form a gap between the first and the second end;

c) repeating steps a) and b) with one or more additional sheets of material each having at least one end that forms a non-linear edge; and d) curing the base sleeve resulting from step c).

27. A cylindrically-shaped printing form precursor comprising:

a) a base sleeve comprising a first sheet of a material having a first end and a second end opposite the first end wrapped to bring the second end adjacent the first end forming a seam of the first and second ends, the base sleeve having an exterior surface; and d) a layer of an imageable material adjacent the exterior surface that covers at least a portion of the seam;

wherein the first end forms a non-linear edge that has an amplitude and overlaps portions of the second end, and wherein the seam comprises one or more of the overlap portions and one or more non-contacting portions that form a gap between the first end and the second end.

28. The precursor of claim 27 wherein the layer of the imageable material is continuous and covers the seam.

29. The precursor of claim 27 wherein the imageable material comprises a photopolymerizable composition of an elastomeric binder, at least one ethylenically unsaturated compound, and a photoinitiator.

30. The precursor of claim 27 wherein the sheet material is a composite material comprising a fibrous material pre-impregnated with a curable resin.

31. The precursor of claim 27 wherein the sheet material is a composite material comprising a fabric material and a thermally-curable resin.

32. The precursor of claim 27 wherein the seam is a discontinuous seam comprising the overlap portion and one or more gap portions between the first end and the second end.

33. The precursor of claim 27 wherein the non-linear edge comprises a waveform of a plurality of waves, each wave having an amplitude which is the same.

34. The precursor of claim 27 wherein the non-linear edge comprises a waveform of a plurality of waves, each wave having an amplitude which is different.

35. The precursor of claim 27 wherein the non-linear edge comprises a waveform of a plurality of waves, each wave having a period width which is the same.

36. The precursor of claim 27 wherein the non-linear edge comprises a waveform of a plurality of waves, each wave having a period width which is different.

37. The precursor of claim 27 wherein the seam is an axial seam of the second end in contact with at least a portion of the amplitude of the non-linear edge.

38. The precursor of claim 27 wherein the second end forms a linear edge.

39. The precursor of claim 27 wherein the second end forms a non-linear edge having an amplitude that is different from the amplitude of the first end.

40. The precursor of claim 27 wherein the non-linear edge comprises a waveform of a plurality of waves, each wave having an amplitude and a period width which are the same, and the second end has a non-linear edge comprising a waveform of a plurality of waves, each wave having an amplitude and a period that are the same or different as the amplitude and period of the first end.

41. The precursor of claim 38 wherein the period of the plurality of waves of the second end is out of phase with the period of the plurality of waves of the first end.

42. The precursor of claim 27 wherein 15 to 90% of the first end forms overlapping portions with the second end.

43. The precursor of claim 27 wherein the amplitude has a height equal to or greater than a print width that is created at a nip between the printing form mounted on a printing cylinder and an impression roll on a print press.

44. The precursor of claim 27 further comprising one or more additional sheets of material on an exterior surface of the first sheet.

45. The precursor of claim 27 further comprising:

an additional sheet of a material having a first end and a second end onto the exterior surface of the base sleeve to bring the second end adjacent the first end of the additional sheet to form a seam of the additional sheet, wherein the first end of the additional sheet forms a non-linear edge that has an amplitude and overlaps portions of the second end of the additional sheet.

46. The precursor of claim 45 wherein the seam of the first sheet is a first axial seam and the seam of the additional sheet is circumferentially offset from the first axial seam.

47. The precursor of claim 45 wherein the base sleeve has an axial length and the seam of the first sheet further comprises a waveform of two or more waves, each wave having an amplitude which can be the same or different and an axial position on the axial length; and the seam of the additional sheet comprises a waveform of two or more waves, each wave having an amplitude which can be the same or different and an axial position on the axial length, wherein the axial position of at least one of the waves of the first sheet is offset from axial position of at least one of the waves of the additional sheet.

* * * * *